United States Patent [19]

Chase et al.

[11] Patent Number: 4,973,272

[45] Date of Patent: Nov. 27, 1990

[54] ELECTRICAL CONNECTOR WITH CONTACTORS

[75] Inventors: Douglas Chase, Redondo Beach; Henry Fernandez, Torrance, both of Calif.

[73] Assignee: Wyle Laboratories, El Segundo, Calif.

[21] Appl. No.: 455,090

[22] Filed: Dec. 22, 1989

Related U.S. Application Data

[63] Continuation-in-part of Ser. No. 8,826, Jan. 30, 1987, Pat. No. 4,906,211.

[51] Int. Cl.[5] ..... H01R 13/00

[52] U.S. Cl. ..... 439/851

[58] Field of Search ..... 439/842, 843, 851

[56] References Cited

U.S. PATENT DOCUMENTS 3,453,587 7/1969 Neidecker ..... 439/843

4,120,557 10/1978 Horrocks ..... 439/843

4,128,293 12/1978 Paoli ..... 439/843

*Primary Examiner*—Joseph H. McGlynn

*Attorney, Agent, or Firm*—Freilich, Hornbaker & Rosen

[57] ABSTRACT

An electrical socket assembly is provided with contactors (50,51, FIG. 3) lying in a pin-receiving hole, which provides a high withdrawal force for the pin (31). Each contactor is of the type that includes a pair of circular bands and a plurality of inwardly-bowed beams extending between the bands to resiliently contact the pin. The assembly includes two of such contactors lying in tandem in the socket hole, to more uniformly guide the pin along the hole, and provide low contact resistance and a high resistance to withdrawal for a pin of given diameter. The socket includes two internal grooves (82,84) that each hold one contactor, and an intermediate wall (80) between the grooves that prevents the contactors from riding up on one another to jam the pin in the hole.

4 Claims, 1 Drawing Sheet

ELECTRICAL CONNECTOR WITH CONTACTORS

BACKGROUND OF THE INVENTION

An airport electrical power supply is often coupled to an airliner parked on the ground by a workman who pulls the outer end of a power cable to the airplane. Sockets at the end of the cable are mated with pins near the bottom of the aircraft, by the workman pressing the cable end up against the pins, and relying upon friction to hold the cable end in place. The weight of the cable end portion extending down from the aircraft to the ground may be about 15 pounds, and the holding power should be several times as much to assure that an accidental disconnection does not occur. An accidental disconnection can damage the cable end when it hits the ground, and can result in sparks that can ignite fuel. When a disconnection is desired, a technician turns off the power and then pulls, preferably with a force of about 80 pounds, to disconnect the cable end. The withdrawal force must be high, such as about 80 pounds, but must not be much higher than that or disconnection is very difficult.

Considerable current flows to the aircraft, and a low resistance connection is desirable to avoid the creation of high temperatures at the connection. A low resistance connection system which assured a predictable unmating force, would be of considerable value.

SUMMARY OF THE INVENTION

In accordance with one embodiment of the present invention, a connection system is provided which includes a socket assembly that assures a predictable unmating force between the socket assembly and a pin assembly of the system. The socket assembly includes a socket having a generally cylindrical hole that holds at least two contactors lying in tandem in the hole. Each contactor is preferably of the type that is formed of thin sheet metal and that includes a pair of opposite largely circular bands connected by a plurality of radially-inwardly bowed beams. The socket has a pair of internal grooves, each holding one contactor, and the socket has an intermediate wall lying between the grooves. The pair of contactors guide the pin along the hole, provide low contact electrical resistance, and can provide high resistance to pin removal. The intermediate wall between grooves prevents the sheet metal contactors from riding up on one another and jamming in the hole.

The novel features of the invention are set forth with particularity in the appended claims. The invention will be best understood from the following description when read in conjunction with the accompanying drawings.

DESCRIPTION OF THE PREFERRED EMBODIMENT

Figure 1:
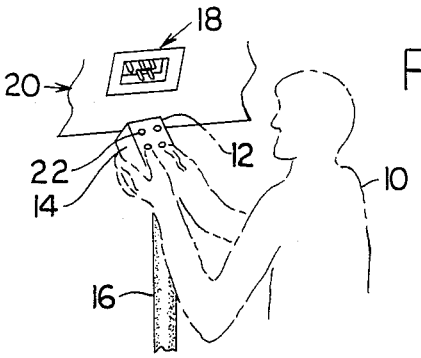
FIG. 1 is a perspective view of a connection system showing the end of a power cable being connected to terminals on an aircraft.

FIG. 1 illustrates a workman 10 who is disconnecting a socket assembly 12 at the forward end 14 of a power cable 16, from an aircraft pin assembly 18. The pin assembly is located on an airliner 20 parked at an airport. In initially connecting the socket and pin assemblies, the workman pushes the cable end forcefully against the pin assembly until they are mated. A switch 22 is then depressed to "turn on" the power, and the connection is left without any auxiliary lock to hold the cable end in place. The frictional force resisting pullout of the socket assembly 12 must be great enough to assure that disconnection will not occur despite vibrations and the like that are encountered. A disconnection of a "hot" cable from the pins on an aircraft can lead to a spark which could ignite fuel vapors that are commonly found in the area. An auxiliary lock is commonly not used because there is a high possibility that workman will not use them.

Figure 2:
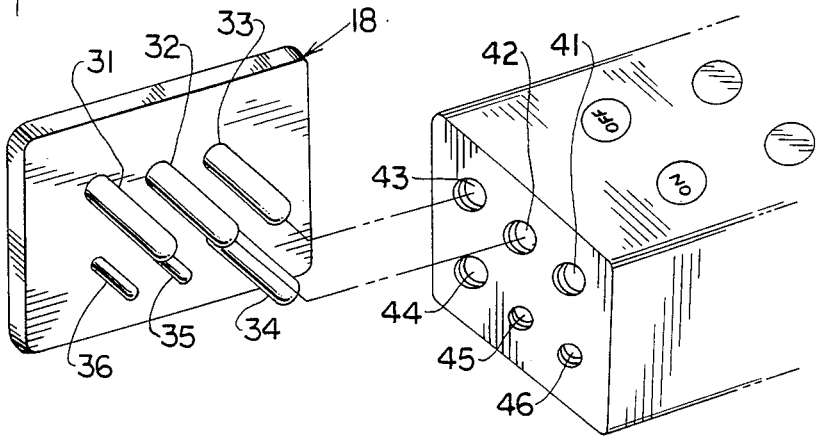
FIG. 2 is a partial perspective view of the cable end and pin arrangement of FIG. 1.

FIG. 2 illustrates a common connection system wherein the pin assembly 18 includes four large pins 31–34 that carry considerable current, and two small pins 35, 36. The socket assembly includes corresponding sockets 41–46. Considerable current may pass between the large pins and sockets, so a large area of contact is required to minimize contact resistance and consequent heating.

Figure 4:
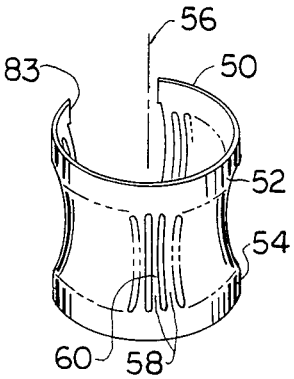
FIG. 4 is a perspective view of a contactor of the socket of FIG. 3, prior to installation of the contactor into the receptacle.

One type of prior art low resistance socket contact is a lam or multi-beam contactor of the type illustrated at 50 in FIG. 4. This contactor includes a pair of spaced substantially circular bands 52, 54 lying on an axis 56, and numerous beams 58 connecting the opposite bands. The beams are inwardly bowed, towards the axis 56, so that the middle 60 of each of the beams can bear against a pin. It should be noted that a variety of such contactors are available, including contactors wherein the inwardly-bowed beams are twisted, and contactors wherein there are short beams extending beyond the opposite bands.

Figure 3:
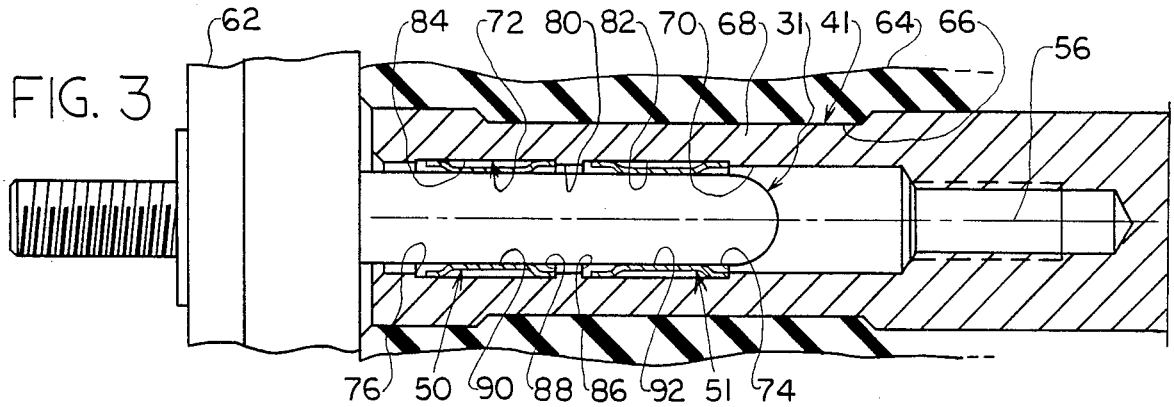
FIG. 3 is a partially sectional view showing a pin and socket of FIG. 2 in a fully mated condition.

FIG. 3 illustrates one part 62 of the connection system showing one of the pins 31 and a corresponding one of the sockets 41. The socket assembly includes a dielectric housing 64 with a socket-holding aperture 66 therein which receives the socket 41. The socket includes a shell 68 having a substantially cylindrical hole 70. Two contactors, including a frontmost contactor 50 and a rearmost contactor 51, lie in the hole. The contactors shown are identical, although they can be different. The hole 70 includes a groove-like recess 72 with rearward and forward shoulders 74, 76 and with an intermediate wall 80 that divides the recess into two separate grooves 82, 84. The intermediate wall 80 which separates the grooves, forms a pair of shoulder 86, 88.

The contacts and shell are formed to provide a high interference fit between the pin 31 and the beams 58 of the contactors. This produces a high friction between the pin and contactors. The high friction results in the need for a workman to apply large forces to insert and withdraw the end of the power cable. Some of the forces may be applied in a direction that tends to tilt the pin 31 with respect to the socket axis 56. The two contactors 50, 51 are arranged in tandem along the socket, and provide two groups of contacts points 90, 92 where the pin is firmly contacted, with these contact points being spaced along the depth of the socket hole. The two contact points help to maintain the pin in alignment with the axis 56 of the hole and contactors, despite forces tending to tilt the pin, which assures the application of largely predictable frictional forces at the beginning of mating. Once the pin begins to withdraw from the socket, the frictional forces are changed from static to the lower sliding friction, and withdrawal proceeds rapidly.

Figure 5:
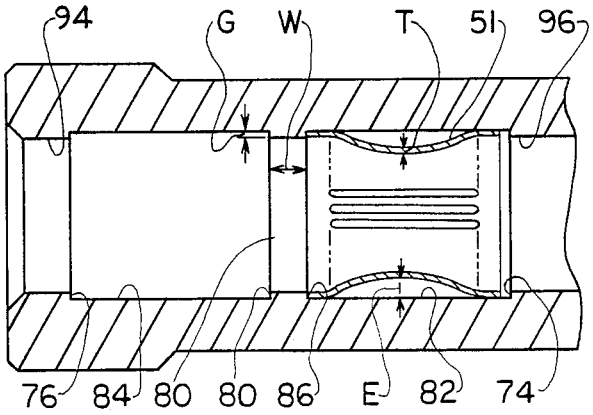
FIG. 5 is an enlarged view of a portion of the system of FIG. 3, with only one contactor shown installed, and with the pin not yet received.

In a connection system constructed by applicant, the large pins such as 31 had an outside diameter of 435 mils (one mil=one thousandth inch) while the socket hole had a diameter of 440 mils with a diameter of 488 mils at the grooves. The socket hole diameter is the same at the intermediate wall 80 as at locations 94, 96 lying forward and rearward of the grooves. The small clearance around the pin 31 at all these locations helps to align the pin with the contactors. The width W of the intermediate wall is 60 mils. Each contactor 50 was formed of sheet stainless steel and had a thickness T of 9 mils, a length of 470 mils, and an initial beam bowing E of 45 mils. Each contactor had 30 beams, each of a width of about 25 mils and a length of 320 mils. Contactors were formed from sheet metal and curved as shown in FIG. 4, with a gap 83 which is largely closed when the contactor is installed in the socket. The depth G (FIG. 5) of the socket groove was 24 mils. The force required to withdraw a connection system of the type shown in FIG. 2, wherein almost all the withdrawal resistance was applied by the 4 large pins, 31–34, was initially 125 lbs., but decreased to about 80 lbs. after about fifty insertions and withdrawals. The withdrawal force remained about constant thereafter. As discussed above, a withdrawal force of about 80 lbs. is desirable to assure that the connection system will remain connected despite the weight of perhaps 15 lbs. of cable tending to pull out the socket assembly. A force of 80 lbs. can be readily applied by most workmen to pull out the socket assembly when necessary. Despite the high withdrawal force, low wear is achieved because each beam can ride over any nicks or other irregularities in a pin.

Applicant earlier formed the recess 72 without any intermediate wall 80 separating it into separate grooves. Applicant found that the resilient sheet metal contactors would sometimes ride one over the other. If one contact rides over the other, then it is possible for the pin to become jammed so that damaging force is required to withdraw it. Also, the contactors can become damaged when a large force is applied to the pin to insert or withdraw it. Applicant found that providing the intermediate wall 80 which results in each contactor lying in a separate groove, avoids riding of one contactor over the other and consequent jamming. It is noted that providing two separate grooves can increase the cost of the assembly, because it requires beginning of machining of the rearmost groove 82 deep within the hole, and also because when the contactors are installed the rearmost of the contactors 51 tends to snap into the frontmost groove 84 if the contactor is not prevented from expansion until it reaches the rearmost groove. However, the avoidance of riding over of contacts provides a great advantage that justifies the additional cost.

Thus, the invention provides a socket which can assure high mechanical resistance to the withdrawal of a pin while minimizing wear of the parts. This is accomplished by the use of a pair of multi-beam contactors lying in tandem in a recess of a socket (it is possible to use more than two contactors in tandem). The contactors engage the pin around two circles that are spaced from each other along the axis of the socket, to help guide the pin during insertion and withdrawal. The recess that holds the two contactors, includes an intermediate wall dividing the recess into two grooves that are spaced apart along the axis of the socket by the width of the intermediate wall. The intermediate wall forms a shoulder at each of the grooves, that prevents a contactor in the groove from riding out of the groove and riding over an end of the other contactor to create a jam with the pin. It should be noted that the use of two contactors also provides a more predictable insertion and withdrawal force and contact resistance because if one of the contactors is oversize the other is unlikely to be, so there is substantial friction and low electrical resistance, and if one of the contactors is undersize it adds less additional friction than if only one contactor were used.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A socket assembly which can receive and electrically connect to a substantially cylindrical pin contact of predetermined diameter and length, comprising:

a dielectric housing which has a socket-holding aperture;

a socket lying in said aperture and having a front end, said socket having a largely cylindrical hole extending into said front end;

first and second multi-beam contactors lying in tandem in said socket hole, each contactor including a pair of opposite bands and a plurality of inwardly bowed beams extending between said bands;

said hole in said socket including a pair of internal grooves including a frontmost groove spaced from said socket front end and a rearmost groove spaced rearwardly from said frontmost groove to leave an intermediate socket wall between them, said first contactor lying in said frontmost groove and said second contactor lying in said rearmist groove, with the rear having of said first contactor and the front of said second contactor each being of a diameter to abut said intermediate socket wall when moved thereagainst.

2. The assembly described in claim 1 wherein:

said intermediate socket wall has a diameter equal to the diameter of portions of said hole walls lying forward of said frontmost groove and rearward of said rearmost groove.

3. The assembly described in claim 1 including:

a pin having a diameter greater than the inside diameter of said contactors and a length great enough to pass into said socket hole and enter both said first and second contactors and deflect their beams outwardly.

4. A socket assembly comprising:

a socket having a front end and a pin-receiving hole extending into said front end, and having at least two internal grooves in the walls of said hole including a first groove nearest said front end and a second groove spaced rearwardly from said first groove to leave an intermediate wall between them;

first and second contactors lying respectively in said first and second holes, each having a plurality of inwardly bowed beams and opposite ends, and the contactor ends lying nearest said intermediate wall each being wide enough to abut said intermediate socket wall when moved thereagainst.

* * * * *